US008485071B2

(12) United States Patent
Wojick

(10) Patent No.: US 8,485,071 B2
(45) Date of Patent: Jul. 16, 2013

(54) SELF-CLAMPING WRENCH WITH PUSH-BUTTON LATCH RELEASE

(76) Inventor: Robert John Terence Wojick, Ontario (CA)

( * ) Notice: Subject to any disclaimer, the term of this patent is extended or adjusted under 35 U.S.C. 154(b) by 0 days.

(21) Appl. No.: 13/106,683

(22) Filed: May 12, 2011

(65) Prior Publication Data

US 2011/0209586 A1 Sep. 1, 2011

Related U.S. Application Data

(63) Continuation-in-part of application No. 12/636,293, filed on Dec. 11, 2009.

(30) Foreign Application Priority Data

Nov. 18, 2009 (CA) ..... 2686026

(51) Int. Cl.
*B25B 13/28* (2006.01)

(52) U.S. Cl.
USPC ..... 81/90.4; 81/90.5; 81/57.34; 192/45

(58) Field of Classification Search
USPC ..... 81/90.1–90.8, 126, 111, 98; 173/1
See application file for complete search history.

(56) References Cited

U.S. PATENT DOCUMENTS

| | | | | |
|---|---|---|---|---|
| 791,814 | A * | 6/1905 | Pitzer | 81/90.4 |
| 807,258 | A | 12/1905 | Foggan | |
| 837,809 | A * | 12/1906 | Dixon | 81/90.4 |
| RE15,863 | E * | 6/1924 | Trew | 81/126 |
| 1,539,943 | A * | 6/1925 | Greve | 81/90.6 |
| 1,593,000 | A * | 7/1926 | Wilson | 81/90.5 |
| 2,099,601 | A | 11/1937 | Fields | |
| 2,339,760 | A * | 1/1944 | Boynton | 81/90.4 |
| 2,510,813 | A | 6/1950 | Gean | |
| 2,576,203 | A | 11/1951 | Wilson | |
| 4,631,990 | A | 12/1986 | Hughes | |
| 7,246,541 | B1 | 7/2007 | Divack | |

FOREIGN PATENT DOCUMENTS

| | | |
|---|---|---|
| CA | 2411595 | 7/1943 |
| WO | WO 96/35553 | 11/1996 |

OTHER PUBLICATIONS

Office Action of Canadian Intellectual Property Office for Canadian Application No. 2,686,026 Dated Dec. 7, 2011 (2 pages).
Product Website (http://www.bgitool.com/nuclear_tooling.html) for Sure Grip Wrench.

* cited by examiner

*Primary Examiner* — Lee D Wilson
*Assistant Examiner* — Melanie Alexander
(74) *Attorney, Agent, or Firm* — Dority & Manning, P.A.

(57) ABSTRACT

A wrench has an elongated handle pivotally connected to a first clamping jaw which is pivotally connected to a second clamping jaw, The wrench has a spring-loaded latch that locks the second clamping jaw to the first clamping jaw. The spring-loaded latch is disengaged by actuating a push-button release mechanism disposed within the handle that causes the spring-loaded latch to pivot to release the second clamping jaw. This press-button release mechanism enables single-handed operation of the wrench. Accordingly, a user can hold and operate two wrenches simultaneously which is not possible with the prior-art wrenches. In other words, the user may clamp a first self-clamping wrench to a tube, pipe, or other such object and then, with only one hand, clamp a second self-clamping wrench to the same tube, pipe, or object.

4 Claims, 4 Drawing Sheets

SELF-CLAMPING WRENCH WITH PUSH-BUTTON LATCH RELEASE

RELATED APPLICATIONS

This application is a continuation-in-part of U.S. patent application Ser. No. 12/636,293 filed on Dec. 11, 2009.

TECHNICAL FIELD

The present technology relates generally to wrenches and, in particular, to wrenches designed to clamp onto a cylindrical object.

BACKGROUND

Wrenches are tools that are designed to apply torque to an object. Many types of wrenches are known in the art. One specific type of wrench, referred to herein as a clamping wrench, is designed to clamp onto the cylindrical outer surface of an object in order to enable a user or operator to apply a torque to the object. One specific example of a clamping wrench is an innertube wrench used for disconnecting an innertube from a drill string.

The clamping wrenches, and particularly the innertube wrenches, known in the art have a pair of clamping arms that are manually latched together to tightly grip the cylindrical outer surface. Typically, two such wrenches are required for applying a torque. However, a problem arises when only a single operator has to use two wrenches, as each wrench requires two hands to latch together. Thus, the lone operator cannot simultaneously latch together the two clamping arms of the second wrench while holding the first wrench. If the first wrench is let go, the latch disconnects, thus making it extremely frustrating and exasperating for the single operator to disconnect the innertube from a drill string. This same problem arises when using these manually operated clamping wrenches in other contexts as well. Because these clamping wrenches are so difficult to operate, two workers are often required, which is economically inefficient. This has remained a technical problem for which an adequate solution has yet to be devised.

SUMMARY

In general, the present invention provides a self-clamping wrench that has an articulated pair of clamping jaws pivotally connected to a handle of the wrench. When the wrench is swung onto a cylindrical or tubular object, the first jaw engages one side of the cylindrical or tubular object. Because the second jaw is pivotally connected to the first jaw, the second jaw pivots ("whips around") the other side of the cylindrical or tubular object until a free end of the second clamping jaw engages a spring-loaded latch pivotally mounted to the handle. When the free end pushes past this spring-loaded latch, the second clamping jaw becomes locked. The first and second clamping jaw, when locked, tightly grip the cylindrical or tubular object within semi-circular (round) gripping portions. To unlock the second clamping jaw from the first clamping jaw, the latch is pressed inwardly, i.e. against the outward force exerted by the spring, to thereby release the free end of the second clamping jaw from the latch. The wrench can then be removed from the object.

Thus, a main aspect of the present invention is a wrench comprising an elongated handle having a proximal end and a distal end. The handle has a first pivot at the distal end and a second pivot also at the distal end. The handle also has a spring-loaded latch pivotally connected to the second pivot. The latch is movable about the second pivot from an unlocked position to a locked position. The wrench further includes a first clamping jaw having a first end pivotally connected to the handle at the first pivot and having a second end that includes a third pivot. The wrench further includes a second clamping jaw pivotally connected to the first clamping jaw via the third pivot to constitute with the first clamping jaw an articulated clamping jaw. The second clamping jaw has a free end for displacing the spring-loaded latch from the unlocked position to the locked position. The latch locks the free end of the second clamping jaw when the free end of the second clamping jaw has pushed past the latch.

In certain embodiments of the invention, the wrench includes a jaw-positioning mechanism that the user employs to open, set or pre-position one of the jaws prior to clamping the wrench onto an object.

Another aspect of the present invention is a method for applying torque to a substantially cylindrical object. The method entails gripping an elongated handle of a wrench having first and second clamping jaws that are pivotally connected to form an articulated clamping jaw that is also pivotally mounted at a proximal end of the first clamping jaw to a distal end of the handle. The method then involves swinging the wrench to cause the first clamping jaw to contact one side of the cylindrical object, thus causing the second clamping jaw pivotally connected to the first clamping jaw to pivot around the cylindrical object until a free end of the second clamping jaw engages a spring-loaded latch pivotally mounted to the handle, thereby locking the second clamping jaw to the first clamping jaw to tightly grip the cylindrical object between the first and second clamping jaws. Finally, the method then involves rotating the wrench to thereby apply torque to the cylindrical object.

Yet another aspect of the present invention is a self-clamping wrench that has an elongated handle having a proximal end and a distal end. The handle has a first pivot at the distal end, a second pivot also at the distal end and a spring-loaded latch pivotally connected to the second pivot, the latch being movable about the second pivot from an unlocked position to a locked position. The wrench has a first clamping jaw having a first end pivotally connected to the handle at the first pivot and having a second end that includes a third pivot and a second clamping jaw pivotally connected to the first clamping jaw via the third pivot to constitute with the first clamping jaw an articulated clamping jaw, the second clamping jaw having a free end for displacing the spring-loaded latch from the unlocked position to the locked position, the latch locking the free end of the second clamping jaw when the free end of the second clamping jaw has pushed past the latch. The spring-loaded latch is connected to a push-button release mechanism for disengaging the second clamping jaw from the latch for one-handed operation.

The details and particulars of these aspects of the invention will now be described below, by way of example, with reference to the attached drawings.

BRIEF DESCRIPTION OF THE DRAWINGS

Further features and advantages of the present technology will become apparent from the following detailed description, taken in combination with the appended drawings, in which.

It will be noted that throughout the appended drawings, like features are identified by like reference numerals.

DETAILED DESCRIPTION

By way of general overview, the present invention provides a self-clamping wrench. This wrench has a first (upper) jaw and a second (lower) jaw that are pivotally connected together to define an articulated clamping jaw. This articulated clamping jaw is itself pivotally connected to a handle of the wrench so that when the wrench is swung onto a cylindrical or tubular object, the first (upper) jaw engages the top side of the cylindrical or tubular object while the second (lower) jaw swing around the underside of the object such that a free end of the second jaw is locked by a spring-loaded latch that is also pivotally mounted to the handle. The free end of the second jaw must swing into the latch with sufficient momentum to displace the spring-loaded latch into a cavity formed in the handle. If the free end displaces this spring-loaded latch sufficiently inwardly to move beyond the latch, the second clamping jaw becomes locked as the spring-loaded latch returns outwardly to its resting position. The pivotal latch thus acts like a cam as the free slides against the outer surface of the latch. The first and second clamping jaws, when locked, tightly grip the cylindrical or tubular object within semi-circular (round) gripping portions. To unlock the second clamping jaw from the first clamping jaw, the latch is pressed inwardly, i.e. against the outward force exerted by the spring, to thereby release the free end of the second clamping jaw from the latch. The unclamped wrench can then be removed from the object.

Figure 1:
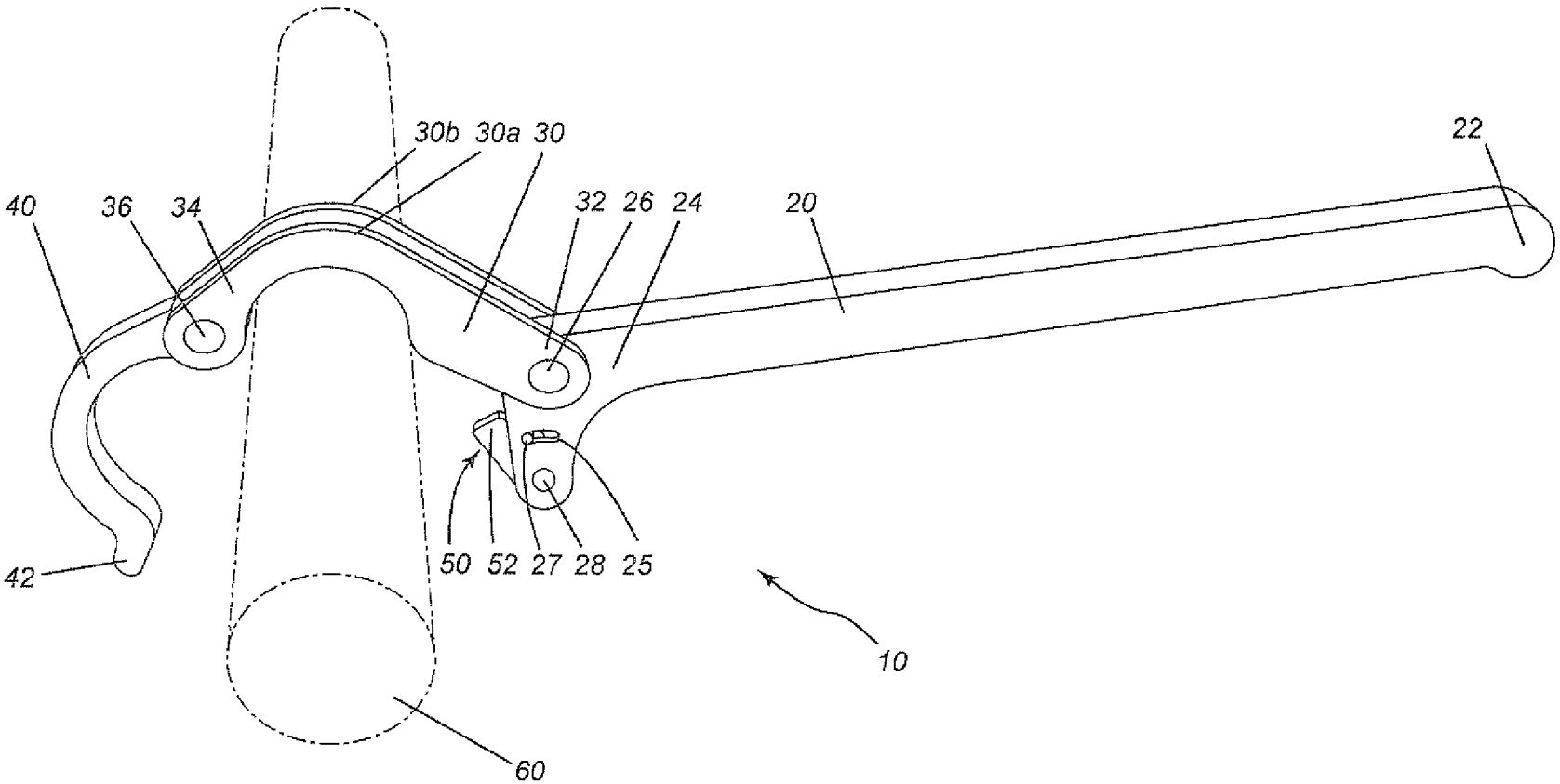
FIG. 1 is a perspective view of a self-clamping wrench in accordance with one embodiment of the present invention.

FIG. 1 depicts a self-clamping wrench in accordance with a main embodiment of the present invention. The wrench, which is designated generally by reference numeral 10, includes an elongated handle 20, a first clamping aim or clamping jaw 30, a second clamping arm or clamping jaw 40 and a spring-loaded latch mechanism 50. The clamping jaws (clamping arms) of this particular version of the wrench are designed to clamp around a cylindrical or tubular object 60 with a generally round or circular cross-section or profile.

In the particular embodiment depicted in FIG. 1, the elongated handle 20 has a proximal end 22 and a distal end 24. The proximal end is the end closest to the body of the user when the user grips the handle with the clamping arms/jaws facing away from the user. The elongated handle is preferably designed for two-handed gripping and operation but may in theory be operated single-handedly. Optionally, moulded or rubberized hand grips may be provided on the handle. At the distal end of the handle are a first pivot 26 and a second pivot 28. The first pivot connects to the first clamping jaw 30. The second pivot connects to the spring-loaded latch mechanism 50. This spring-loaded latch mechanism comprises a spring-loaded latch 52 that is pivotally connected to the second pivot 28. The latch 52 is thus movable about the second pivot from an unlocked position to a locked position.

As further depicted in FIG. 1, the first clamping jaw includes a first end 32 pivotally connected to the handle 20 at the first pivot 26 and having a second end 34 that includes a third pivot 36.

As further depicted in FIG. 1, the second clamping jaw 40 is pivotally connected to the first clamping jaw 30 via the third pivot 36 to constitute with the first clamping jaw an articulated clamping jaw. The second clamping jaw 40 has a free end (tip) 42 for displacing the spring-loaded latch 52 from the unlocked position to the locked position, the latch 52 locking the free end of the second clamping jaw when the free end of the second clamping jaw has pushed past the latch 52.

The first ("upper") clamping jaw 20 may be made of a single unitary jaw or two substantially identical jaw components spaced apart by a small gap as to allow connection to the narrower handle via a pin joint (or equivalent) at the first pivot 26 such as in the manner shown in FIG. 1. The spaced-apart jaw components 30*a*, 30*b* of the upper jaw (first jaw) also allow connection by a pin joint (or equivalent) to the narrower second clamping arm (second jaw). As will be appreciated, the specific construction details of this embodiment are presented solely by way of example. The wrench first and second jaws may be constructed and interconnected in various other ways, as will be appreciated by those of ordinary skill in the art, without departing from the underlying inventive concept.

In one embodiment, as depicted in FIG. 1, the free end 42 (distal end) of the second clamping jaw 40 may be hooked (bent) to better engage the latch 52 (i.e. to lock against the latch when the free end pushes past the latch).

In one embodiment, as depicted in FIG. 1, the handle 20 includes a cavity or internal space into which the latch may retreat when depressed by the free end of the second clamping jaw.

As further illustrated, the handle 20 may also include a guide groove 25 (such as, for example, the curved guide groove shown in FIG. 1). A pin 27 connected to the latch slides within this guide groove, thereby constraining and limiting the rotational motion of the latch. In the embodiment shown, the guide groove subtends an angle that is equal to or slightly greater than the angle that the latch must rotate to allow the free end of the second clamping arm to push past the latch.

The first and second clamping arms (jaws) may have semi-circular grips or gripping portions having the same radius of curvature as the cylindrical or tubular object they are designed to clamp so as to fit snugly around the cylindrical or tubular object when the free end is latched into the locked position.

FIGS. 2A to 2D illustrate operation of the embodiment of the wrench introduced in FIG. 1. These four illustrations show the kinematics of the linkages of the wrench as it is swung into clamping engagement with a cylindrical object.

Figure 2A:
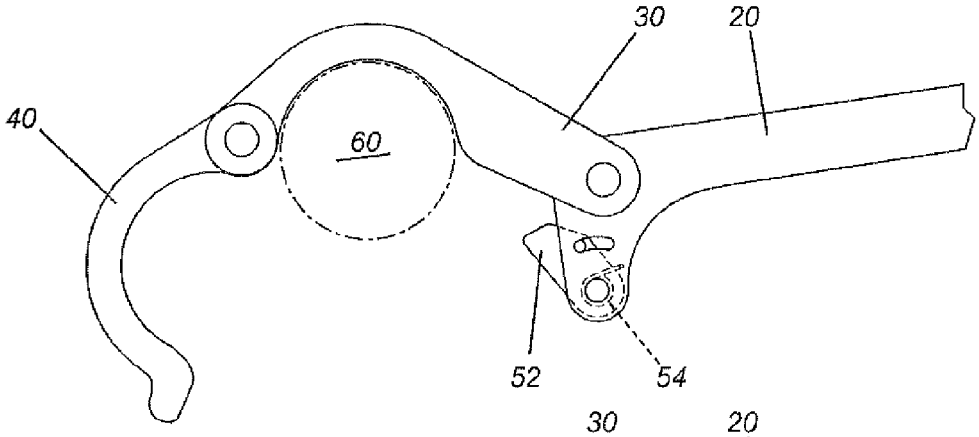
FIG. 2A is a side elevation view of the self-clamping wrench of FIG. 1, depicting the first jaw contacting a top side of a cylindrical or tubular object that is to be clamped.
Figure 2B:
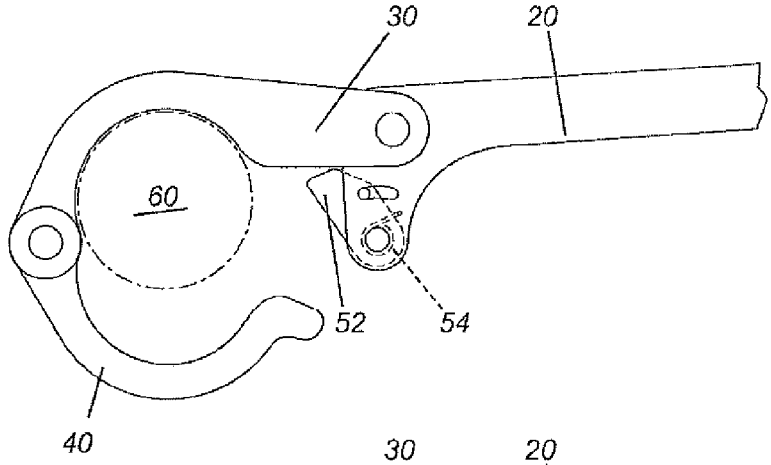
FIG. 2B is a side elevation view of the wrench of FIG. 1, depicting the second jaw pivoting around the bottom side of the cylindrical or tubular object to be clamped.
Figure 2C:
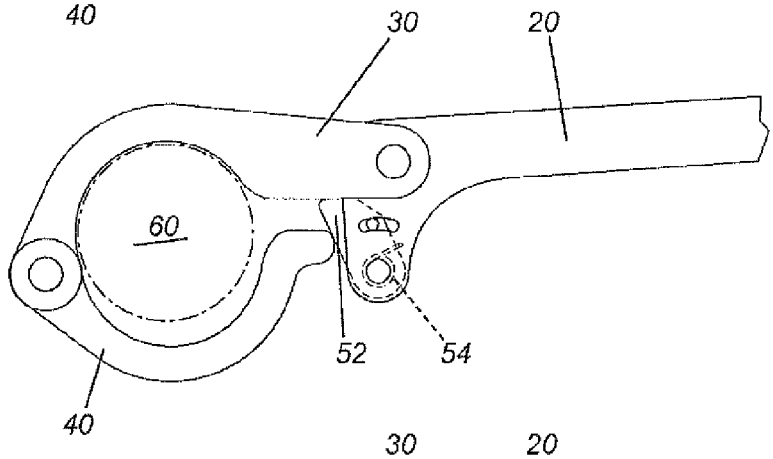
FIG. 2C is a side elevation view of the wrench of FIG. 1, depicting the free end of the second jaw pressing against and rotationally displacing the spring-loaded latch.
Figure 2D:
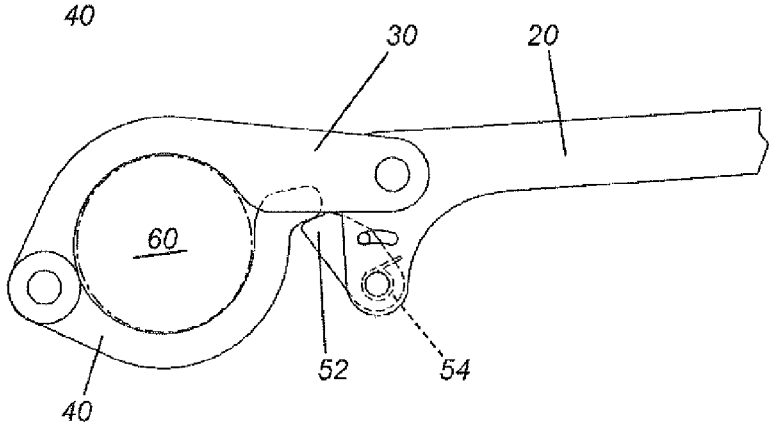
FIG. 2D is a side elevation view of the wrench of FIG. 1, depicting the free end of the second jaw locked by the spring-loaded latch.

Initially, the wrench is swung onto the cylindrical or tubular object to be clamped such that the semi-circular gripping portion of the first arm (first jaw) contacts (engages) the top side of the cylindrical/tubular object, as shown in FIG. 2A. Due to the articulation (pivot connection joining the first and second arms), the second arm wraps underneath the cylindrical/tubular object, as shown in FIG. 2B. Due to the momentum of the second clamping arm, this arm swings upwardly into engagement with the latch, pushing and displacing the latch into the cavity formed in the handle, as shown in FIG. 2C. The free end continues to displace the latch until the free end has moved past the latch, as illustrated in FIG. 2D, whereupon the spring-loaded latch moves back toward its original position, thereby locking the free end of the second jaw tightly against the first jaw. As shown in FIGS. 2A-2D, the spring-loaded latch 52 may be connected to a torsional coil spring mounted about the pivot second pivot 28 to resist rotation of the latch (and thus to urge the latch back to its original resting position when the latch is rotated).

There are a number of different embodiments of this wrench. In a first embodiment, the wrench exploits the inertia of the various components to wrap the clamping jaws around the cylindrical/tubular object. In other words, by accelerating the handle faster than the jaws, the jaws can be made to whip around the object, locking automatically into the latch mechanism.

In further embodiments, the wrench further includes a jaw-positioning mechanism. This jaw-positioning mechanism enables the top jaw (or top pair of jaws) to be pre-positioned in a predetermined posture prior to actuation or engagement of the self-clamping wrench.

Figure 3:
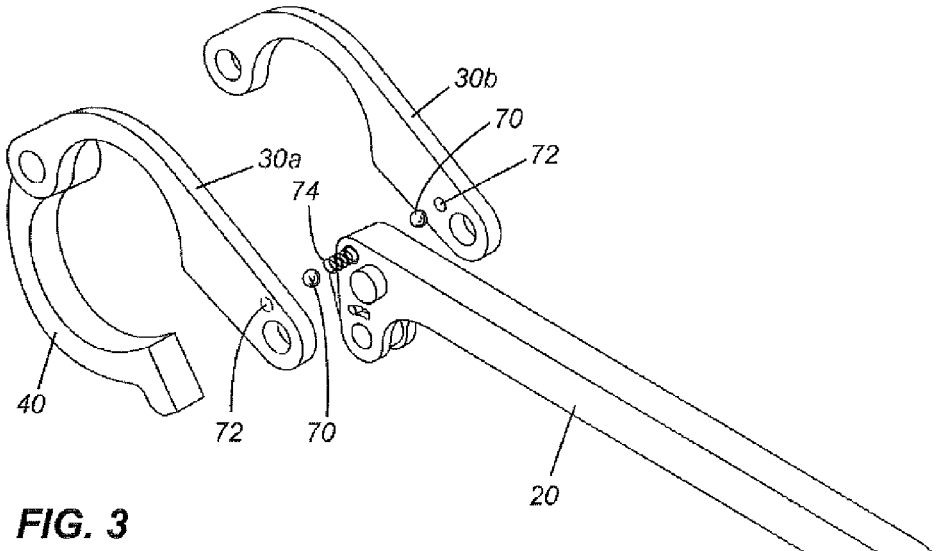
FIG. 3 is a perspective view of another embodiment of the wrench having a spring and ball-detent mechanism for pre-positioning the first jaw in a predetermined posture prior to engagement of the wrench.

Accordingly, in a second embodiment depicted in FIG. 3, a spring and ball-detent mechanism acts on the top jaw(s) to pre-position the top jaw(s) prior to actuation/engagement of the self-clamping wrench. In FIG. 3, the ball 70 engages an appropriately sized detent 72 formed in the inside surface of the jaw components 30*a*, 30*b*. A spring 74 urges the ball into the detent. In the specific embodiment shown, there are two balls and detents on each of the two jaw components of the upper jaw. A single spring may be installed in a hole in the handle so as to act on each ball concurrently. Alternatively, two springs may be provided on each side of the handle to act on respective balls.

Figure 4:
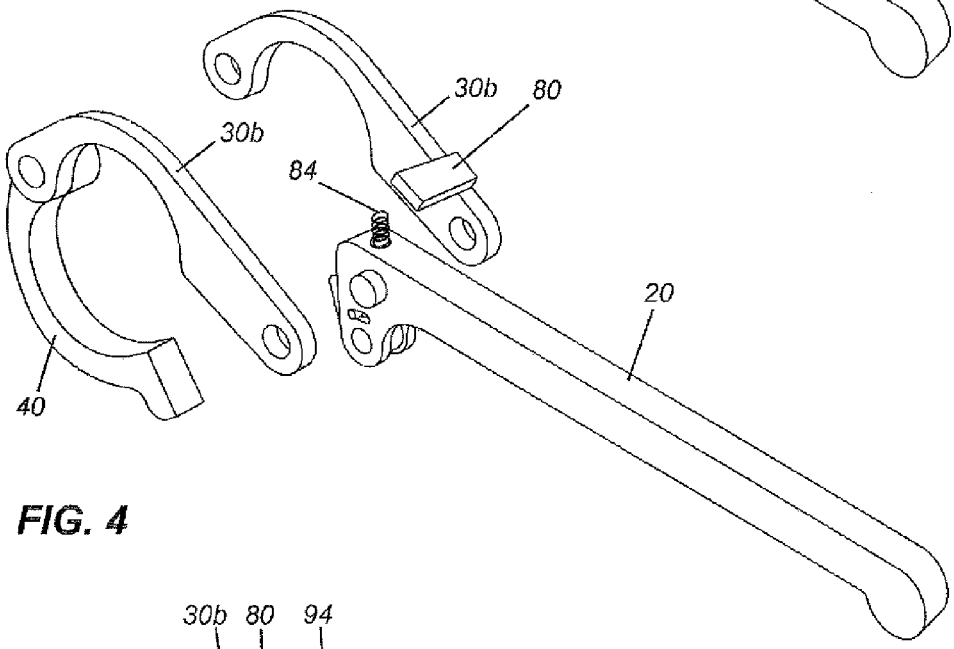
FIG. 4 is a perspective view of another embodiment of the wrench having a compression spring acting on an underside of a jaw bridge for pre-positioning the first jaw in a predetermined posture prior to engagement of the wrench.
Figure 5:
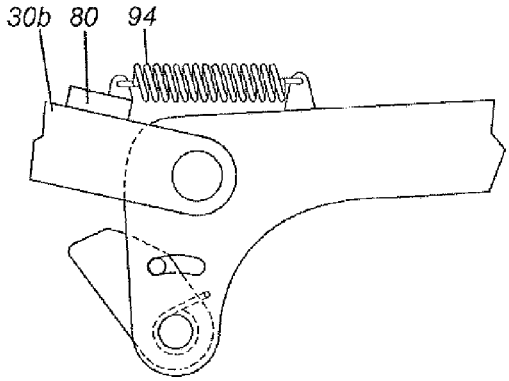
FIG. 5 is a side elevation view of another embodiment of the wrench having a tension spring acting on the top side of a jaw bridge for pre-positioning the first jaw in a predetermined posture prior to engagement of the wrench.

In a third embodiment depicted in FIG. 4, a compression spring 84 acts on a jaw bridge 80 that spans across the top jaws 30*a*, 30*b*. In a fourth embodiment depicted in FIG. 5, which is similar to the embodiment depicted in FIG. 4, a tension spring 94 acts on the top side of the jaw bridge 80. These various mechanisms hold the top jaw(s) in place. The idea is to prepare the wrench manually by pulling (pre-positioning) the top jaw into an open (ready) position so to provide proper clearance. The jaw-positioning mechanism, be it a spring and ball-detent, compression spring or tension spring, will hold the upper jaw in place. This obviates the need to snap the wrench to create the requisite clearance. Accordingly, by pre-positioning the upper jaw using a jaw-positioning mechanism, the sole purpose of snapping the wrench is to wrap the bottom jaw around the underside of the innertube (or other cylindrical object).

The novel wrench also serves as a tool that enables a novel method of applying torque to a substantially cylindrical object. This novel method entails first gripping an elongated handle of a wrench. The wrench, as described above, has first and second clamping jaws that are pivotally connected to form an articulated clamping jaw that is also pivotally mounted at a proximal end of the first clamping jaw to a distal end of the handle. Next, the user swings the wrench to cause the first clamping jaw to contact one side of the cylindrical object. This causes the second clamping jaw to pivot around the cylindrical object until a free end of the second clamping jaw engages a spring-loaded latch pivotally mounted to the handle. Thus locks the second clamping jaw to the first clamping jaw (and thus tightly grips the cylindrical object between the first and second clamping jaws). Finally, the user rotates the wrench about an axis of the cylindrical object to thus apply torque to the cylindrical object.

This method is most useful in the context of dismantling an innertube from a diamond drill string. However, it may be used in many other contexts as well to apply torque to an object that is cylindrical or tubular. As will be appreciated, the semi-circular gripping portions could be modified to have any other shape to thus grip onto a non-circular object. In other words, this wrench technology is not necessarily limited to a wrench having semi-circular grips.

This method enables a single user to quickly and easily clamp the wrench and apply torque. A corollary benefit of this new self-clamping wrench technology is that a single user can sequentially clamp two such wrenches, i.e. clamp a first wrench and then clamp a second wrench (while maintaining the first wrench in a clamped position). This enables a user to clamp two such wrenches to two connected components or parts, e.g. an innertube and the rest of the drill string, and then to apply equal and opposite torques to disconnect the two connected components.

Figure 6:
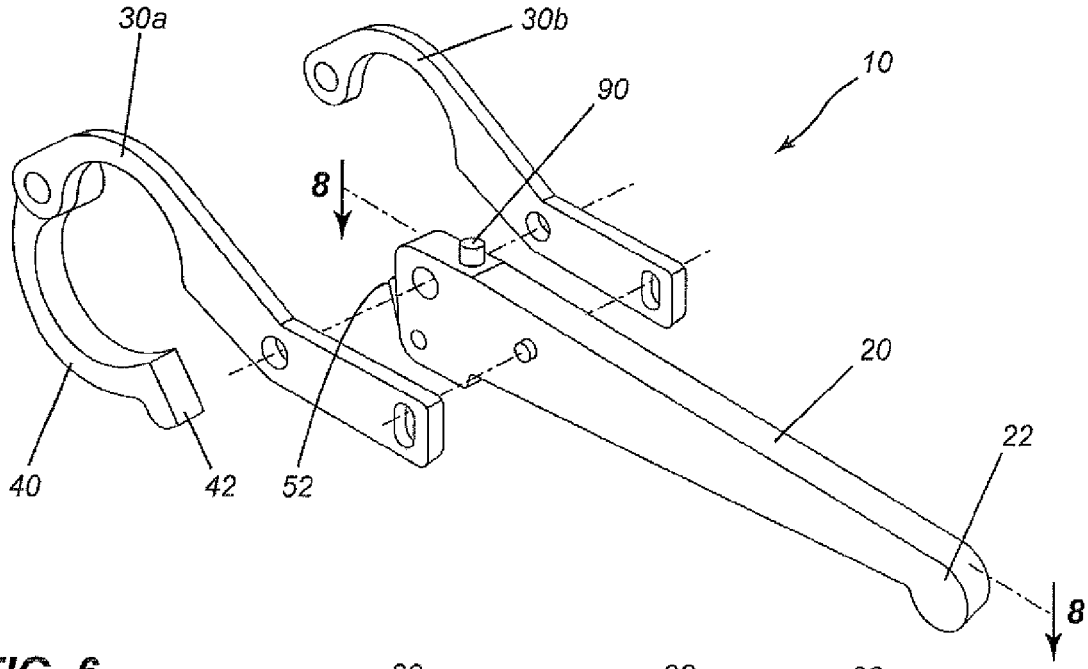
FIG. 6 is a perspective view of a self-clamping wrench with a push-button latch release in accordance with another embodiment of the present invention.
Figure 7:
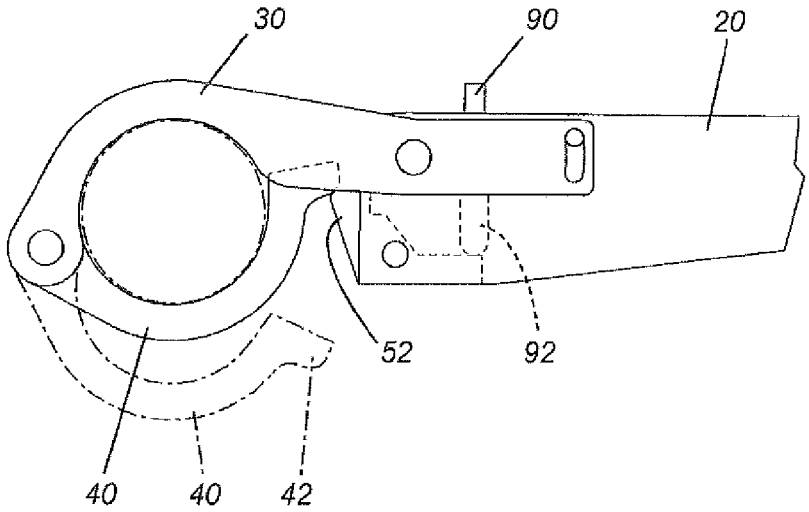
FIG. 7 is a side view of the wrench of FIG. 6.
Figure 8:
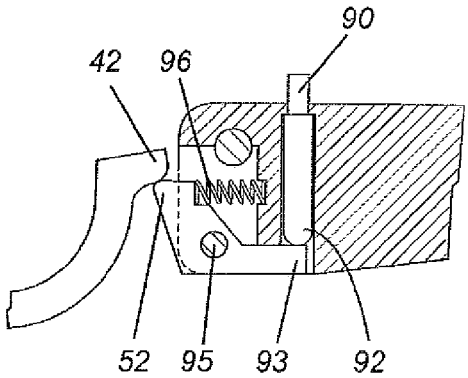
FIG. 8 is a cross-sectional view of the latching mechanism of the wrench of FIG. 6 with the latch engaged.
Figure 9:
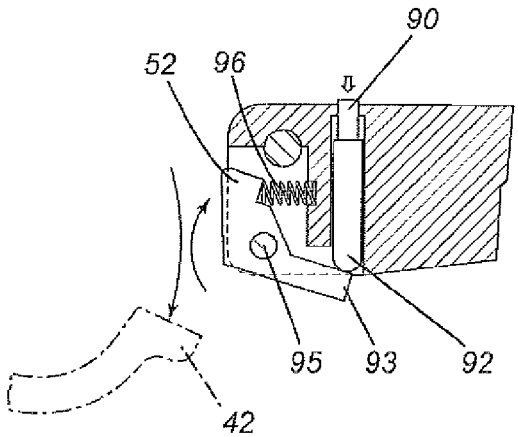
FIG. 9 is a cross-sectional view of the latching mechanism of the wrench of FIG. 6 shown with the latch disengaged by the push button release.

A further embodiment of the present invention, which is depicted in FIGS. 6-9, is a self-clamping wrench with a push-button release. A spring-loaded latch is connected to a push-button release mechanism for disengaging the second clamping jaw from the latch. This push-button release can be actuated by a user's thumb while holding the wrench. The push-button release enables this wrench to be operated single-handedly. In particular, FIG. 6 is a perspective view of the self-clamping wrench 10 with the push-button latch release 90. FIG. 7 is a side view of the wrench 10, showing the movement of the clamping jaw 40 as its tip 42 engages and disengages the latch 52. FIG. 8 and FIG. 9 are cross-sectional views of the latching mechanism showing, respectively, the latch 52 in the latched position (FIG. 8) and in the disengaged position (FIG. 9).

As depicted in FIG. 6, the self-clamping wrench 10 has a latch 52 extending forwardly as part of a latching mechanism housed in a forward portion of the handle 20. The latch 52 engages the free end (tip) 42 of the clamping jaw 40. The clamping jaw 40 is hinged or pivotally connected to upper jaws 30*a*, 30*b* as already described with respect to the previous embodiments depicted in FIGS. 1 to 5.

As depicted in FIG. 7, the tip 42 of the clamping jaw pushes the latch 52 rearwardly to move past the latch. The latch is spring-loaded so that it pivotally retracts when the tip 42 presses against it. When the tip 42 has moved past the latch, the spring-loaded latch returns to its original position, thereby locking the clamping jaw in place as shown by the solid lines in FIG. 7.

As depicted in FIG. 8 and in FIG. 9, the latching mechanism includes a thumb-actuated or finger-actuated button 90 that triggers the press-button release member (plunger) 92. This member bears against a bottom lever 93 to cause the latch 52 to pivot about pivot point 95. A spring 96 links the latch 52 to the housing so as to return the latch 52 to its original position after the clamping jaw has moved past the latch. The spring 96 also has the effect of returning the bottom lever 93 to its original position substantially flush with the underside of the housing. As the bottom lever 93 pivots back to its original position, the push-button release member (plunger) 92 and the button 90 are also returned to their original position. Actuation of this push-button 90 thus causes the latch 52 to release the clamping jaw 40.

This press-button release mechanism enables single-handed operation of the wrench. Accordingly, a user can hold and operate two wrenches simultaneously which is not possible with the prior-art wrenches. In other words, the user may clamp a first self-clamping wrench to a tube, pipe, or other such object and then, with only one hand, clamp a second self-clamping wrench to the same tube, pipe, or object.

This invention has been described in terms of specific examples, embodiments, implementations and configurations which are intended to be exemplary only. Persons of ordinary skill in the art will appreciate that obvious variations, modifications and refinements will become apparent from the present disclosure and that these can be made without departing from the scope of the present invention. The scope of the exclusive right sought by the Applicant is therefore intended to be limited solely by the appended claims.

The invention claimed is:

1. A self-clamping wrench comprising:

a handle having an elongated member defining a proximal end and a distal end, the handle defining a top side and a bottom side, also defining a cavity integrally formed with the elongated member at said distal end and extending away from the top side, the handle having:

a first pivot at the distal end;

a second pivot also at the distal end;

a spring-loaded latch pivotal within the cavity and pivotally connected to the second pivot, wherein one end of the spring-loaded latch extends toward the top side from the second pivot and another end forms a bottom lever, the latch being movable about the second pivot from an unlocked position to a locked position by pivoting toward the proximal end;

a first clamping jaw having a first end pivotally connected to the handle at the first pivot and having a second end that includes a third pivot; and a second clamping jaw pivotally connected to the first clamping jaw via the third pivot to constitute with the first clamping jaw an articulated clamping jaw, the second clamping jaw having a free end for displacing the spring-loaded latch from the unlocked position to the locked position, the latch locking the free end of the second clamping jaw when the free end of the second clamping jaw has pushed past the latch, wherein the spring-loaded latch is actuated by a push-button release mechanism that extends within the handle for disengaging the second clamping jaw from the latch, wherein the spring-loaded latch is actuated by a push-button release mechanism that extends within the handle proximate the spring-loaded latch for disengaging the second clamping jaw from the latch.

2. The wrench as claimed in claim 1 wherein the push-button release mechanism comprises a button connected to a plunger bearing against a bottom lever for pivoting the latch about a pivot point.

3. The wrench as claimed in claim 1 wherein the button extends above an upper surface of the handle.

4. The wrench as claimed in claim 2 wherein the button extends above an upper surface of the handle.

* * * * *